US006508390B1

(12) United States Patent
Karpati

(10) Patent No.: US 6,508,390 B1
(45) Date of Patent: Jan. 21, 2003

(54) BELT MOUNTED HOLDER FOR SPACKLE ITEMS

(75) Inventor: Thomas Karpati, Lindenhurst, NY (US)

(73) Assignee: Thomas E. Karpati, Lindenhurst, NY (US)

( * ) Notice: Subject to any disclaimer, the term of this patent is extended or adjusted under 35 U.S.C. 154(b) by 0 days.

(21) Appl. No.: 09/919,259

(22) Filed: Jul. 30, 2001

(51) Int. Cl.[7] ..... A45F 5/00

(52) U.S. Cl. ..... 224/270; 224/200; 224/272; 224/676; 224/678; 224/904

(58) Field of Search ..... 224/270, 148.7, 224/195, 197, 200, 676, 628, 679, 680, 240, 242, 271, 272, 904, 191, 232, 234

(56) References Cited

U.S. PATENT DOCUMENTS

| | | | | | |
|---|---|---|---|---|---|
| 947,024 | A | * | 1/1910 | Paine et al. | 224/270 |
| 4,300,708 | A | | 11/1981 | Pattermann | |
| 4,303,188 | A | | 12/1981 | Calabrese | |
| 4,325,503 | A | | 4/1982 | Swinney | |
| 4,363,433 | A | | 12/1982 | Jaques | |
| 4,638,530 | A | * | 1/1987 | Perry | 224/904 |
| D311,672 | S | | 10/1990 | Johnson | |
| 5,358,161 | A | | 10/1994 | Perugini | |
| 5,385,281 | A | | 1/1995 | Byrd | |
| 5,489,051 | A | | 2/1996 | Robinson | |
| 5,609,282 | A | | 3/1997 | Melanson | |
| 5,626,272 | A | * | 5/1997 | Klemansky | 206/362 |
| 5,826,762 | A | * | 10/1998 | Dellinger | 224/232 |
| 6,213,365 | B1 | | 4/2001 | Stocke | |

FOREIGN PATENT DOCUMENTS

| | | | | |
|---|---|---|---|---|
| GB | 10111 | * | 6/1889 | 224/270 |

* cited by examiner

*Primary Examiner*—Stephen K. Cronin
*Assistant Examiner*—Maerema W. Brevard
(74) *Attorney, Agent, or Firm*—Thomas E. Karpati

(57) ABSTRACT

A belt-mounted holder for spackle items. More particularly, the invention is an item that is removably attachable to a belt of a user, and functions to hold a hawk or spackle device so that the user does not have to put the item down while working. The holder is preferably constructed of simple metals or plastics, and consists of two main panels that are hingedly attached. A generally vertical panel is affixed to the user's belt area and stays against the user's body. The second panel folds down from the first panel to a position parallel to the ground. The panel folds and stays in such a position through usage of a spring loaded mechanism. Located on the second panel is a hole of sufficient diameter to receive the handle portion of the hawk.

10 Claims, 3 Drawing Sheets

BELT MOUNTED HOLDER FOR SPACKLE ITEMS

BACKGROUND OF THE INVENTION

1. Field of the Invention

The present invention is a belt-mounted holder for spackle items. More particularly, the invention is an item that is removably attachable to a belt of a user, and functions to hold a hawk or spackle device so that the user does not have to put the item down while working. The holder is preferably constructed of simple metals or plastics, and consists of two main panels that are hingedly attached. A generally vertical panel is affixed to the user's belt area and stays against the user's body. The second panel folds down from the first panel to a position parallel to the ground. The panel folds and stays in such a position through usage of a spring loaded mechanism. Located on the second panel is a hole of sufficient diameter to receive the handle portion of the hawk.

Importantly, the invention is of sufficient length to allow the hawk to securely sit without interfering with the user's body. In addition, the holder is small enough in size for the user's elbow to clear the item when in use. Regarding additional features, the present invention may include a hook or holding means for other tools, such as a scraper, blade, or other item. In total, the present invention provides a convenient and inexpensive way for one to hold spackle items on their person while working—including on ladders or scaffolding—without the user having to constantly put the hawk down and rotate it as spackle runs from one edge of the item to another.

2. Description of the Prior Art

Numerous innovations for tool and implement-holding devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 5,358,161, Invented by Perugini, Entitled "Belt Mounted Spackle Pan Holder"

The patent to Perugini describes a spackle pall holder for holding a spackle pan having a closed bottom end, an open top end, and inclined peripheral walls. The holder is an open top holder having inclined peripheral walls, a bottom wall, and a clip assembly located on one of the inclined peripheral walls of the holder adjacent to the open top. The clip assembly enables the holder to be detachably attached to the belt of a person. The clip should be large enough and of suitable construction to ensure that the weight of the holder, the pan, and the spackle compound contained within the pan are adequately secured to the belt. The holder has a shape approximating that of the spackle pan to provide a frictional engagement therebetween. Alternatively, the inclination of the peripheral walls of the spackle pan is greater than that of the side walls of the holder to substantially eliminate friction therebetween. Preferably, the peripheral walls of the holder are provided with openings to ensure that a spackle pan is used in combination with the holder and that the holder is not used in substitution of a spackle pan. The pan, upon engagement with the holder, extends approximately one inch above the top of the holder to enable the user to easily grasp and remove the pan therefrom.

2. U.S. Pat. No. 5,489,051, Invented by Robinson, Entitled "Painter's Pouch"

The patent to Robinson describes a gravity responsive apparatus for the carriage of paint and paint application related tools suspended upon the hip of a painter which consists of a hip-supported, belt-attached base member which is flexibly attached by means of a separable ball and socket joint to a freely swinging sealable paint container and fitted tool carrier. Use of the device allows a painter to easily and safely scale ladders and scaffolds without danger of paint spillage and upon arrival at the place of application of paint to simply flip open and fold back the hinged, gasketed cover for access to the paint supply. A variety of painters preparation and application tools may be carried in the integral tool rack which is a part of the apparatus. The freely swinging construction allows the painter to assume almost any position without the probability of paint spillage or tool droppage and being fabricated of a smooth, seamless material, is readily cleanable and requires little care or maintenance.

3. U.S. Pat. No. 4,363,433, Invented by Jaques, entitled "Painter's Holster"

The patent to Jacques describes a painter's holster including loops for attaching the holster to a belt, a substantially rectangular paint reservoir having a top opening downwardly beveled from back to front for convenient brush access to the reservoir, a V-shaped paint brush container secured to an external side of the reservoir to hold a paint brush securely and to prevent drying of the paint on the brush. The holster may also contain a second paint brush container on an opposite side, identical to the first brush container, and may further include a sponge brush applicator container on the front external wall of the reservoir.

4. U.S. Pat. No. 6,213,365, Invented by Stocke et al., Entitled "Painter's Utility Belt"

The patent to Stocke et al. describes a painter's utility belt comprised of an elongated sash with a widened middle portion embedded with lumbar support inserts. The ends of the sash are releasably attached by a buckle on an adjustable strap. A strip of reinforcing webbing is attached longitudinally on the sash. Loops are formed along the webbing for holding tools, such as a scraper and screwdrivers. A pocket is centered on the sash for holding a sanding block. A pair of vertical loops closed with buckles are attached near the ends of the sash for holding caulking guns, tape, or paint cans. A pair of D-rings are attached to the webbing near the opposite ends for holding a hammer, a rag, etc. A pair of combination pockets are releasably attached to the sash in positions corresponding to the hip positions on the user. The combination pockets are each comprised of a paint pocket lined with a liquid resistant material for holding paint, and a plurality of tool pockets for holding tools. Each combination pocket also includes loops for holding pail hooks, spray gun handles, cell phones, pagers, etc. Thus the belt can hold enough paint and tools for surface preparation as well as paint application work.

5. U.S. Design Pat. No. 311,672, Invented by Johnson, Entitled "Putty Holder"

The design patent to Johnson depicts an ornamental design for a putty holder, as shown.

6. U.S. Pat. No. 5,609,282, Invented by Melanson, Entitled "Belt-Mounted Receptacles And Tote Tray Therefor"

The patent to Melanson describes a tote tray with a carrying handle having a number of openings in its upper surface. Held securely within each opening is a rigid receptacle having an open top and closed sides and bottom. A belt clip is connected along one side so that the receptacle can be clipped to the belt for a worker to carry about a readily available supply of small items such as fasteners on the job.

A supply of various styles and sizes of small items is conveniently carried to the job site in the tote tray, and whatever is needed is then clipped to the belt for as long as required. The tote tray is supplied with a belt clip engaging element adjacent each opening. The belt clip is springably engaged thereto when the receptacle is inserted into the opening. This provides more secure holding of the receptacle in the tray. The clip engaging element is arranged to position the clip along an outer vertical side of the tray so that the receptacle may be more easily grasped by the clip to keep the fingers away from contact with the items in the receptacle.

7. U.S. Pat. No. 4,303,188, Invented by Calabrese, Entitled "Drywall And Plastering Knife Caddy"

In the patent to Calabrese, there is disclosed a knife caddy and more particularly a caddy for carrying one or a plurality of various size drywall or plastering knives. The caddy is comprised of two sections, the smaller one of which may be disengaged from the larger section for portable use and can be carried on the worker's belt with several knives contained therein.

8. U.S. Pat. No. 4,300,708, Invented by Pattermann, Entitled "Drywall Taper's Tool Carrier And Combinations Therewith"

The patent to Pattermann describes a carrier for a drywall taper's broad knife having a main pocket for the broad knife and an auxiliary pocket for a shear knife. The carrier includes three pocket wall forming components that are preferably made from leather. The opening at the upper end of the pocket is generally inclined and the arrangement is such that the handle of the broad knife comes to rest in a recessed upper edge portion at the upper end of one of the narrow side walls while the working edge of the knife blade confronts the opposite narrow side wall in the pocket structure.

9. U.S. Pat. No. 5,385,281, Invented by Byrd, Entitled "Painter's Utility Belt"

In the patent to Byrd, a painter's utility belt provides for the carriage of at least one paint can and a variety of additional tools and equipment likely to be needed by a painter. The belt includes a first loop which may be secured about a paint can below the bail lugs on the sides of the can to support the can from the belt, and a second loop which may be secured about a section of PVC pipe or the like to provide for the storage of a caulking gun or the like therein. The loops are openable and adjustably closeable for different sizes of containers or the like, and are offset from the center of the belt to preclude interference with a ladder or other structure directly to the front of a wearer of the belt. An apron portion is also provided, with the apron having a plurality of open pockets of different sizes therein for the storage of various tools and articles. The device may be made of a variety of natural or synthetic materials; preferably, the belt and loop portions are formed of polypropylene, while the apron portion is formed of canvas. The belt and loops may be secured by a side latch buckle or the like; other alternatives are possible also.

10. U.S. Pat. No. 4,325,503, Invented by Swinney, Entitled "Painter's Belt-On Brush And Bucket Holder And Carrier"

The patent to Swinney describes an article for carrying a bucket and paintbrush on a painter so as to leave his hands free, having a rack portion to which the bucket is secured, a member supported by a belt, and connecting means between rack and member providing movement between them so that the weight of the bucket and rack maintains the bucket upright as the painter moves about while damping its tendency to oscillate.

The aforementioned prior art patents illustrate various designs including: soft pouches for various tools; holsters for paint brushes; utility belts for tools and knives; and belt-mounted holders for paint containers and pans.

In contrast to the above, the present invention is a holder that consists of a vertical panel affixed to the user's belt and against the user's body, and a second panel that folds parallel to the ground. The device includes a spring-loaded mechanism and hinge assembly, and the second panel includes a hole to receive the handle portion of the hawk. The length and size of the device allows the hawk to securely sit without interfering with the user's arms or body. In addition, the invention may include a holding means for other tools that the painter or worker may need. Therefore, the present invention provides a convenient and inexpensive way for one to hold spackle items on their person while working, without having to put the items down.

SUMMARY OF THE INVENTION

As noted, the present invention is a belt-mounted holder for spackle items. More particularly, the invention is an item that is removably attachable to a belt of a user, and functions to hold a hawk or spackle device so that the user does not have to put the item down while working. The holder is preferably constructed of simple metals or plastics, and consists of two main panels that are hingedly attached. A generally vertical panel is affixed to the user's belt area and stays against the user's body. The second panel folds down from the first panel to a position parallel to the ground. The panel folds and stays in such a position through usage of a spring loaded mechanism. Located on the second panel is a hole of sufficient diameter to receive the handle portion of the hawk.

Importantly, the invention is of sufficient length to allow the hawk to securely sit without interfering with the user's body. In addition, the holder is small enough in size for the user's elbow to clear the item when in use. Regarding additional features, the present invention may include a hook or holding means for other tools, such as a scraper, blade, or other item. In total, the present invention provides a convenient and inexpensive way for one to hold spackle items on their person while working—including on ladders or scaffolding—without the user having to constantly put the items down.

In light of the foregoing, it is generally an object of the present invention to provide a device that allows one to hold a hawk or spackle device so that the user does not have to put the item down while working.

It is a further object of the invention to provide a device that can hold additional relevant items, such as by a simple hook or hooks attached to the device.

It is a further object of the invention to provide a device that is relatively lightweight and comfortable for the user to wear while working.

It is a further object of the present invention to provide a device that is relatively inexpensive to manufacture, produce, and distribute.

It is a further object of the present invention to provide a device that may be manufactured in a variety of shapes and sizes.

In addition, it is an object of the present invention to provide a device that is compact in nature and easy for a user to transport.

It is an object of the present invention to provide a device that may include text or graphics thereon, for the purposes of advertisement.

It is also an object of the present invention to provide a device that may a hold a variety of sizes of hawks, so as to make the device effective for many different jobs.

Finally, it is an object of the present invention to provide alternate embodiments of the device, wherein the invention is constructed of different materials, according to-manufacturer and user needs.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
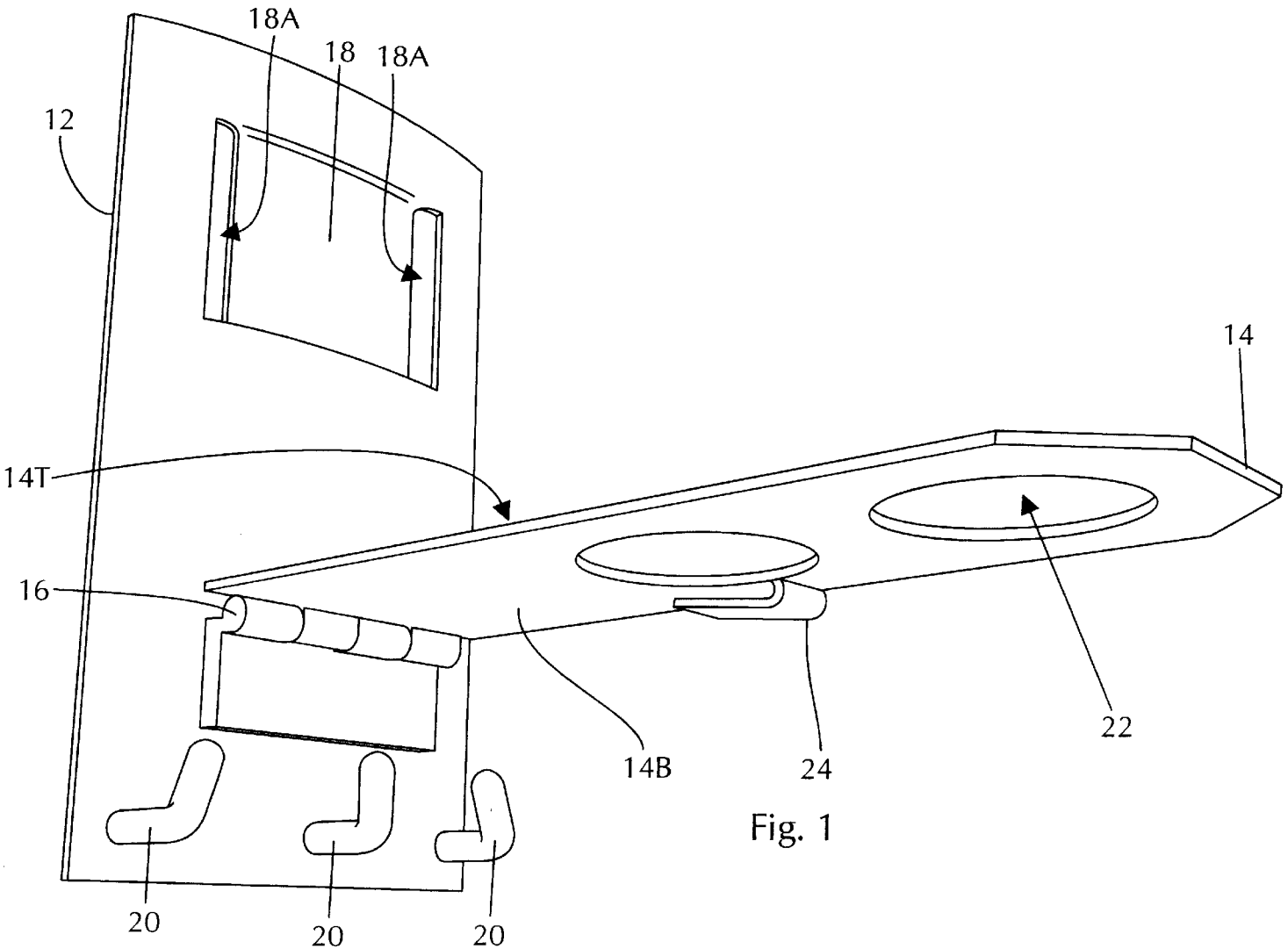
FIG. 1 is a front, three-quarter perspective view of the present invention, illustrating the device in folded down position, without implements thereon.
Figure 2:
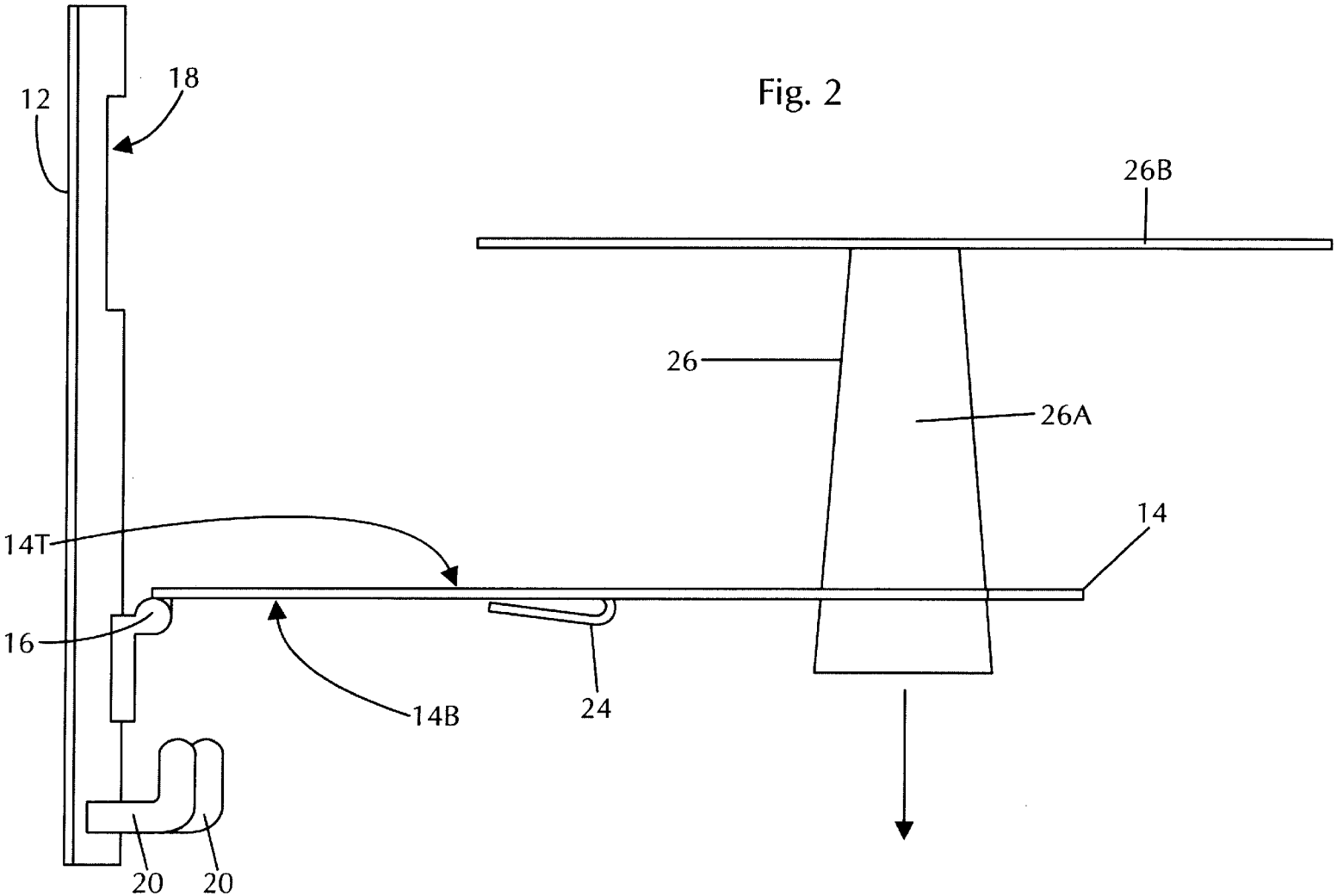
FIG. 2 is a side perspective view of the present invention, illustrating the device in-folded down position, with traditional hawk placed thereon.

The following description relates to FIG. 1, which is a front, three-quarter perspective view of the present invention, illustrating the device in folded down position, without implements thereon; FIG. 2, which is a side perspective view of the present invention, illustrating the device in folded down position, with traditional hawk placed thereon; and FIG. 3, which is a front, three-quarter perspective view of the present invention, illustrating the device in folded down position, with spackle containing implement:

Specifically, the belt mounted holder for spackle items comprises a generally lightweight, vertical member (12) which comprises a front surface and rear surface. The vertical member (12) is removably attachable to a belt area of a user through usage of an attachment means (18), which comprises attachment slots (18A). Importantly, the attachment means (18) may be manufactured in a variety of sizes, so as to fit multiple sized belts, such as a one inch belt or three inch belt. In addition, the holder may be affixed to the left or right side of the user for correlation to left or right handed persons. If desired, the present invention can also be affixed to the front or back area of the user. In any instance, the vertical member (12) may be slightly rounded in configuration to better fit the contour of a user's body.

A horizontal panel (14) is affixed to the vertical member (12) at one end thereof through usage of a hinge device (16). In the preferred mode, the horizontal panel (14) folds and stays a position parallel to a ground surface through usage of a spring loaded mechanism. The horizontal is able to fold downwardly from the vertical member (12) so as to extend outwardly from vertical member (12) in a generally perpendicular configuration. As desired by the manufacturer, the horizontal panel (14) may fold upwardly or downwardly from the vertical member (12).

Horizontal panel (14) comprises a top surface (14T) and a bottom surface (14B). Horizontal panel (14) further comprises at least one aperture (22) of sufficient diameter to receive a handle portion (26A) of a hawk device (26) in a generally perpendicular position. The hawk device (26) further comprises a flat top surface (26B) on which spackle is placed, much in the traditional manner.

Thus, the foregoing functions to allow a user to conveniently keep the hawk on his or her person at all times during the job, rather than having to place the same down on a floor or flat surface constantly. This will increase the efficiency of the worker, and allow for more effective performance in a shorter period of time.

Vertical member (12) further comprises at least one hook (20), which functions to hold additional items relating to spackle and paint. For instance, as shown in FIG. 1, the assembly may consist of a total of three hooks placed near the bottom of the vertical member (12), which allow the present invention to hold scrapers, blades or other implements.

Figure 3:
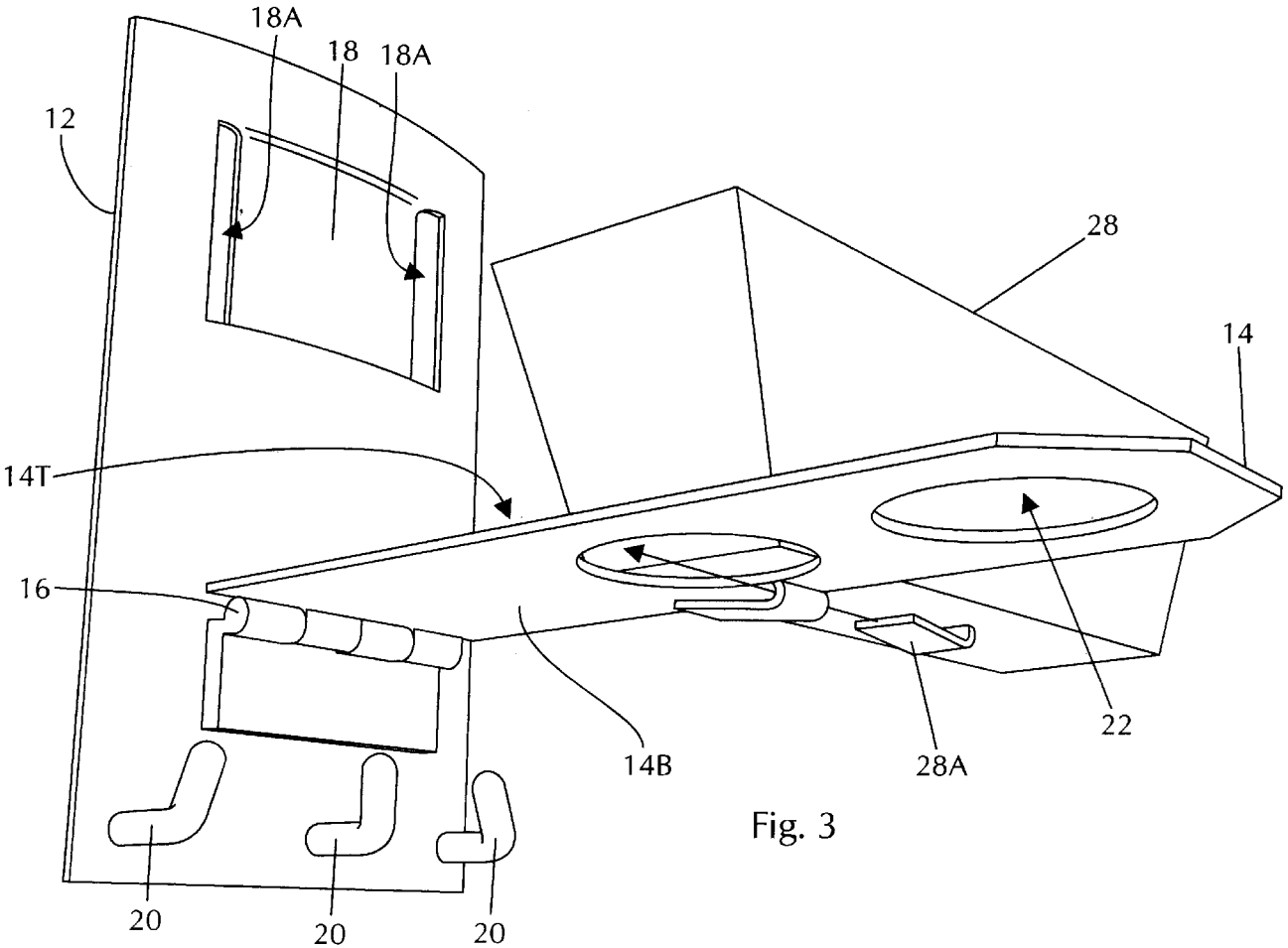
FIG. 3 is a front, three-quarter perspective view of the present invention, illustrating the device in folded down position, with spackle containing implement.

In one mode of production, the horizontal panel (14) further comprises a fastening means (24) extending from a bottom portion (14B) thereof. The fastening means (24) functions to allow a spackle containing device (28) that is held within the belt mounted holder to affix thereto, as depicted in FIG. 3.

In an alternate mode of manufacture, the device further comprises at least one pocket which functions to hold additional items relating to spackle and paint. In addition, the device may bear indicia, text; and graphics thereon, if deemed appropriate by the manufacturer.

Generally, all components of the holder are manufactured of a material selected from the group consisting of metal, plastic, and polymers. Such materials are largely inexpensive, durable, and easy for the manufacturer to work with.

Also, in general, the holder of the present invention may manufactured in a variety of sizes for the utmost in versatility. Furthermore, the horizontal member (14) may comprise a total of two apertures (22), each of a different diameter size, functioning to allow the device to hold hawks of varying sizes. This embodiment, shown in FIG. 1, also adds significantly to the versatility of the holder.

In all cases, the device is intended to be of a configuration that is comfortable for the user to wear for extended periods of time, and especially comfortable for the user who needs to use ladders, stairs, or scaffolding during the job in question. It is imperative to note that the device clears the user's elbow, such that the user can swing his or her arm in the manner required for the job without any interference with the present invention.

Moreover, the device need no be very large to accomplish the aforementioned purposes. So as to render the device more attractive to workers, the device may be of a compact enough size to fit in a user's pocket or toolbox for ease of transport between usage.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A belt mounted holder for spackle items comprising:

a generally lightweight, vertical member (12) which comprises a front surface and rear surface, vertical member (12) removably attachable to a belt area of a user through usage of an attachment means (18), which comprises attachment slots (18A), vertical member (12) further comprising at least one hook (20), which functions to hold additional items relating to spackle and paint;

a horizontal panel (14) affixed to the vertical member (12) at one end thereof through usage of a hinge device (16), the horizontal member able to fold downwardly from the vertical member (12) so as to extend outwardly from vertical member (12) in a generally perpendicular configuration and, said horizontal panel (14) comprising a top surface (14T) and a bottom surface (14B), horizontal panel (14) further comprising at least one aperture (22) of sufficient diameter to receive a handle portion (26A) of a hawk device (26) in a generally perpendicular position, the hawk device (26) further comprising a flat top surface (26B) on which spackle is placed, functioning to allow a user to conveniently keep the hawk on the user's person at all times during work.

2. The belt mounted holder for spackle items as described in claim 1, wherein the horizontal panel (14) folds and stays a position parallel to a ground surface through usage of a spring loaded mechanism.

3. The belt mounted holder for spackle items as described in claim 1, wherein the horizontal panel (14) further comprises a fastening means (24) extending from a bottom portion (14B), the fastening means (24) functioning to allow a spackle containing device (28) that is held within the belt mounted holder to affix thereto.

4. The belt mounted holder for spackle items as described in claim 1, wherein the holder is manufactured of a material selected from the group consisting of metal, plastic, and polymers.

5. The belt mounted holder for spackle items as described in claim 1, wherein the holder functions to hold a scraper, blade, or other item relating to spackle or paint.

6. The belt mounted holder for spackle items as described in claim 1, wherein the holder is manufactured in a variety of sizes.

7. The belt mounted holder for spackle items as described in claim 1, wherein the horizontal member (14) comprises a total of two apertures (22), each of a different diameter size, functioning to allow the device to hold hawks of varying sizes.

8. The belt mounted holder for spackle items as described in claim 1, wherein the vertical member (12) is slightly rounded to fit the contour of a user's side.

9. The belt mounted holder for spackle items as described in claim 1, wherein the attachment means (18) is manufactured in a variety of sizes so as to fit multiple sized belts.

10. The belt mounted holder for spackle items as described in claim 1, wherein the holder is affixed to left or right side of the user for correlation to left or right handed persons.

* * * * *